US010472583B2

(12) United States Patent
Utaka

(10) Patent No.: US 10,472,583 B2
(45) Date of Patent: Nov. 12, 2019

(54) LUBRICATING OIL COMPOSITION

(71) Applicant: IDEMITSU KOSAN CO., LTD., Chiyoda-ku (JP)

(72) Inventor: Toshimasa Utaka, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/318,837

(22) PCT Filed: Sep. 18, 2015

(86) PCT No.: PCT/JP2015/076809

§ 371 (c)(1),
(2) Date: Dec. 14, 2016

(87) PCT Pub. No.: WO2016/043334

PCT Pub. Date: Mar. 24, 2016

(65) Prior Publication Data

US 2017/0137732 A1 May 18, 2017

(30) Foreign Application Priority Data

Sep. 19, 2014 (JP) ..... 2014-191909

(51) Int. Cl.

| | |
|---|---|
| ***C10M 171/02*** | (2006.01) |
| ***C10L 10/08*** | (2006.01) |
| ***C10L 1/16*** | (2006.01) |
| ***C10L 1/195*** | (2006.01) |
| ***C10L 1/197*** | (2006.01) |
| ***C10L 1/236*** | (2006.01) |
| ***C10M 169/04*** | (2006.01) |

(52) U.S. Cl.

CPC ..... *C10L 10/08* (2013.01); *C10L 1/1641* (2013.01); *C10L 1/1955* (2013.01); *C10L 1/1973* (2013.01); *C10L 1/2364* (2013.01); *C10M 169/044* (2013.01); *C10M 171/02* (2013.01); *C10M 2203/1025* (2013.01); *C10M 2205/02* (2013.01); *C10M 2205/022* (2013.01); *C10M 2205/028* (2013.01); *C10M 2207/023* (2013.01); *C10M 2207/026* (2013.01); *C10M 2207/262* (2013.01); *C10M 2209/04* (2013.01); *C10M 2209/084* (2013.01); *C10M 2215/064* (2013.01); *C10M 2215/28* (2013.01); *C10M 2217/024* (2013.01); *C10M 2223/045* (2013.01); *C10M 2227/00* (2013.01); *C10M 2229/02* (2013.01); *C10N 2210/01* (2013.01); *C10N 2210/02* (2013.01); *C10N 2210/06* (2013.01); *C10N 2220/021* (2013.01); *C10N 2220/028* (2013.01); *C10N 2220/032* (2013.01); *C10N 2230/02* (2013.01); *C10N 2230/04* (2013.01); *C10N 2230/06* (2013.01); *C10N 2230/10* (2013.01); *C10N 2230/18* (2013.01); *C10N 2230/68* (2013.01)

(58) Field of Classification Search

CPC ..... C10N 2230/02; C10M 2209/084

USPC ..... 508/591, 195

See application file for complete search history.

(56) References Cited

U.S. PATENT DOCUMENTS

| | | | | |
|---|---|---|---|---|
| 2010/0190671 | A1† | 7/2010 | Stoehr | |
| 2011/0306533 | A1* | 12/2011 | Eisenberg | C08F 290/048 508/471 |
| 2013/0196888 | A1 | 8/2013 | Troung-Dinh | |

FOREIGN PATENT DOCUMENTS

| | | | |
|---|---|---|---|
| CN | 101687963 | | 3/2010 |
| CN | 102348789 | | 2/2012 |
| CN | 104471042 | | 3/2015 |
| JP | 2007-217494 | A | 8/2007 |
| JP | 2014-210844 | A | 11/2014 |
| WO | 2009/007147 | A1 | 1/2009 |
| WO | 2012/025901 | A1 | 3/2012 |
| WO | 2013/189951 | A1 | 12/2013 |

OTHER PUBLICATIONS

International Search Report dated Dec. 15, 2015 in PCT/JP2015/076809 filed Sep. 18, 2015.

(Continued)

*Primary Examiner* — Vishal V Vasisth

(74) *Attorney, Agent, or Firm* — Oblon, McClelland, Maier & Neustadt, L.L.P.

(57) ABSTRACT

The present invention provides a lubricating oil composition including a viscosity index improver (A) containing a comb-shaped polymer and having an SSI (shear stability index) of 30 or less together with a base oil, wherein an HTHS viscosity (high temperature high shear viscosity) at 150° C. ($T_{150}$) is 1.6 to 2.9 mPa·s, and a ratio of a kinematic viscosity at 40° C. ($V_{40}$) [$mm^2/s$] to the HTHS viscosity at 150° C. ($T_{150}$) [mPa·s] ($V_{40}/T_{150}$) is 12.4 or less. The lubricating oil composition of the present invention is excellent in fuel consumption reducing properties in a low-temperature region assuming the time of starting an engine while making various properties, such as a viscosity, etc., in a high-temperature region assuming the time of high-speed operation of an engine favorable.

17 Claims, No Drawings

(56) References Cited

OTHER PUBLICATIONS

Extended European Search Report dated Jun. 26, 2018 in Patent Application No. 15842880.5.
Office Action dated Aug. 1, 2019, in corresponding Chinese patent Application No. 201580032116.6.
Office Action dated Sep. 10, 2019, in corresponding Indian Patent Application No. 201747008614 (with English-language Translation).

* cited by examiner
† cited by third party

LUBRICATING OIL COMPOSITION

This application is a 371 of PCT/JP2015/076809, filed Sep. 18, 2015.

TECHNICAL FIELD

The present invention relates to a lubricating oil composition.

BACKGROUND ART

In recent years, for the purposes of effective use of oil resources and emission reduction of $CO_2$, fuel consumption reduction of vehicles, such as automobiles, etc., is eagerly required. For that reason, a demand of fuel consumption reduction for a lubricating oil composition that is used for engines of vehicles, such as automobiles, etc., is also becoming strong.

For example, PTL 1 discloses a lubricating oil composition for internal combustion engine, in which an ashless dispersant, a polymethacrylate-based viscosity index improver whose PSSI (permanent shear stability index) falls within a predetermined range, and the like are contained in a lubricating base oil, and a ratio of a viscosity index and an HTHS viscosity (high temperature high shear viscosity) at 100° C. is regulated to a predetermined range.

PTL 1 mentions that the foregoing lubricating oil composition for internal combustion engine is high in torque reduction rate under conditions of an oil temperature of 80° C. and good in fuel consumption reducing properties in a high-temperature region as compared with the conventional ones.

CITATION LIST

Patent Literature

PTL 1: JP 2007-217494 A

SUMMARY OF INVENTION

Technical Problem

Conventionally, as the fuel consumption reducing properties of engine oils, it was general to make the fuel consumption performance in a temperature region at about 80 to 100° C. mainly assuming the post-completion of warming up of an engine subjective. However, in recent years, the fuel consumption reducing properties in a low-temperature region at about 25 to 60° C. assuming the time of starting an engine are also required.

In PTL 1, though the fuel consumption reducing properties at 80° C. assuming the post-completion of warming up of an engine are studied, the fuel consumption reducing properties in a low-temperature region assuming the time of starting an engine are not studied. In addition, according to the investigations made by the present inventor and others, it has become clear that the lubricating oil composition for internal combustion engine described in PTL 1 involves such a problem that the fuel consumption reducing properties in a low-temperature region assuming the time of starting an engine are inferior.

An object of the present invention is to provide a lubricating oil composition that is excellent in fuel consumption reducing properties in a low-temperature region assuming the time of starting an engine while making various properties, such as a viscosity, etc., in a high-temperature region assuming the time of high-speed operation of an engine favorable.

Solution to Problem

The present inventor and others have found that a lubricating oil composition including a viscosity index improver containing a comb-shaped polymer and having a SSI (shear stability index) regulated to a predetermined range together with a base oil, in which an HTHS viscosity at 150° C. and a kinematic viscosity at 40° C. are regulated to predetermined ranges, respectively, is able to solve the aforementioned problem, leading to accomplishment of the present invention.

Specifically, the present invention is to provide the following [1] to [3].

[1] A lubricating oil composition including a viscosity index improver (A) containing a comb-shaped polymer and having an SSI (shear stability index) of 30 or less together with a base oil, wherein an HTHS viscosity (high temperature high shear viscosity) at 150° C. ($T_{150}$) is 1.6 to 2.9 mPa·s, and a ratio of a kinematic viscosity at 40° C. ($V_{40}$) [$mm^2/s$] to the HTHS viscosity at 150° C. ($T_{150}$) [mPa·s] ($V_{40}/T_{150}$) is 12.4 or less.

[2] A use method of a lubricating oil composition including using the lubricating oil composition as set forth above in [1] in a low-temperature region at 10 to 60° C.

[3] A method for producing a lubricating oil composition including a step (I) of blending a base oil with a viscosity index improver (A) containing a comb-shaped polymer and having an SSI (shear stability index) of 30 or less, thereby preparing a lubricating oil composition such that an HTHS viscosity (high temperature high shear viscosity) at 150° C. ($T_{150}$) is 1.6 to 2.9 mPa·s, and a ratio of a kinematic viscosity at 40° C. ($V_{40}$) [$mm^2/s$] to the HTHS viscosity at 150° C. ($T_{150}$) [mPa·s] ($V_{40}/T_{150}$) is 12.4 or less.

Advantageous Effects of Invention

The lubricating oil composition of the present invention is excellent in fuel consumption reducing properties in a low-temperature region assuming the time of starting an engine while making various properties, such as a viscosity, etc., in a high-temperature region assuming the time of high-speed operation of an engine favorable.

DESCRIPTION OF EMBODIMENTS

In the present specification, the "kinematic viscosity at 40° C. or 100° C." and the "viscosity index" mean values as measured in conformity with JIS K2283.

In the present specification, the "HTHS viscosity at 150° C. or 100° C." is a value of a high temperature high shear viscosity at 150° C. or 100° C. as measured in conformity with ASTM D4741, and specifically, it means a value as measured by the method described in the Examples.

In the present specification, each of a weight average molecular weight (Mw) and a number average molecular weight (Mn) means a value as converted into standard polystyrene, as measured by the gel permeation chromatography (GPC) method, and specifically, it means a value as measured by the measurement apparatus under the measurement conditions described in the Examples.

In the present specification, the terms "in a high-temperature region assuming the time of high-speed operation of an engine" refer to an atmosphere in a temperature range of typically 80 to 180° C. (preferably 80 to 150° C.).

Meanwhile, the terms "in a low-temperature region assuming the time of starting an engine" refer to an atmosphere in a temperature range of typically 10 to 60° C. (preferably 20 to 60° C.).

In the present specification, for example, the "(meth) acrylate" is used as a terminology expressing both an "acrylate" and a "methacrylate", and other analogous terms or similar expressions are also the same.

In the present specification, the "alkali metal atom" refers to a lithium atom (Li), a sodium atom (Na), a potassium atom (K), a rubidium atom (Rb), a cesium atom (Cs), or a francium atom (Fr).

The "alkaline earth metal atom" refers to a beryllium atom (Be), a magnesium atom (Mg), a calcium atom (Ca), a strontium atom (Sr), or a barium atom (Ba).

[Lubricating Oil Composition]

The lubricating oil composition of the present invention includes a viscosity index improver (A) containing a comb-shaped polymer and having an SSI (shear stability index) of 30 or less together with a base oil, wherein an HTHS viscosity (high temperature high shear viscosity) at 150° C. ($T_{150}$) is 1.6 to 2.9 mPa·s, and a ratio of a kinematic viscosity at 40° C. ($V_{40}$) [$mm^2/s$] to the HTHS viscosity at 150° C. ($T_{150}$) [mPa·s] ($V_{40}/T_{150}$) is 12.4 or less.

In the lubricating oil composition of the present invention, it is required that the HTHS viscosity at 150° C. ($T_{150}$) is 1.6 to 2.9 mPa·s.

When the foregoing HTHS viscosity ($T_{150}$) is less than 1.6 mPa·s, the lubricating performance tends to be lowered, and hence, such is not preferred. On the other hand, when the foregoing HTHS viscosity ($T_{150}$) is more than 2.9 mPa·s, not only the viscosity characteristic at a low temperature tends to be lowered, but also the fuel consumption reducing properties is lowered, and hence, such is not preferred.

From the aforementioned viewpoint, in the embodiment of the present invention, the HTHS viscosity at 150° C. ($T_{150}$) of the lubricating oil composition is preferably 1.7 to 2.8 mPa·s, more preferably 1.8 to 2.8 mPa·s, still more preferably 1.9 to 2.7 mPa·s, and yet still more preferably 2.0 to 2.7 mPa·s.

The HTHS viscosity ($T_{150}$) can also be assumed as a viscosity in a high-temperature region at the time of high-speed operation of an engine. Namely, so long as the HTHS viscosity at 150° C. ($T_{150}$) of the obtained lubricating oil composition falls within the aforementioned range, it may be said that the lubricating oil composition is favorable in various properties, such as a viscosity in a high-temperature region assuming the time of high-speed operation of an engine, etc.

In the lubricating oil composition of the present invention, it is required that the ratio of the kinematic viscosity at 40° C. ($V_{40}$) and the HTHS viscosity at 150° C. ($T_{150}$) ($V_{40}/T_{150}$) is 12.4 or less.

The present inventor and others have found that the ratio ($V_{40}/T_{150}$) is an indicator for the fuel consumption reducing properties in a low-temperature region assuming the time of starting an engine and accomplished the present invention. Namely, a lubricating oil composition, the ratio ($V_{40}/T_{150}$) of which is more than 12.4, is insufficient in the fuel consumption reducing properties in a low-temperature region assuming the time of starting an engine.

From the aforementioned viewpoint, the ratio of the kinematic viscosity at 40° C. ($V_{40}$) and the HTHS viscosity at 150° C. ($T_{150}$) ($V_{40}/T_{150}$) of the lubricating oil composition according to the embodiment of the present invention is preferably 12.2 or less, more preferably 12.0 or less, still more preferably 11.7 or less, and yet still more preferably 11.5 or less.

In the lubricating oil composition according to the embodiment of the present invention, though a lower limit value of the ratio ($V_{40}/T_{150}$) is not particularly limited, the ratio ($V_{40}/T_{150}$) is typically 6.00 or more, and preferably 8.00 or more.

In the lubricating oil composition of the present invention, it is possible to regulate the values of the HTHS viscosity ($T_{150}$) and the ratio ($V_{40}/T_{150}$) by mainly properly setting a degree of refining, a content, a kinematic viscosity, and a viscosity index of the base oil to be used, a content, a weight average molecular weight (Mw), and a molecular weight distribution (Mw/Mn) of the comb-shaped polymer, an SSI of the viscosity index improver (A), a content of the viscosity index improver (A), and so on.

More specifically, for example, the values of the HTHS viscosity ($T_{150}$) and ratio ($V_{40}/T_{150}$) can be regulated to the desired ranges taking into consideration the following items (a) to (b).

(a) When the content of the viscosity index improver (A) is increased, the HTHS viscosity ($T_{150}$) tends to increase. For that reason, the value of the HTHS viscosity ($T_{150}$) can be readily regulated by property regulating the content of the viscosity index improver (A).

(b) As the content of the viscosity index improver (A) is increased, the kinematic viscosity ($V_{40}$) tends to also increase. In particular, in the case of using a viscosity index improver not corresponding to the comb-shaped polymer, such as PMA, etc., or a viscosity index improver having a high value of SSI, the foregoing tendency conspicuously appears.

It may be also said that the use of the comb-shaped polymer as the viscosity index improver contributes to the regulation of the values of the HTHS viscosity ($T_{150}$) and ratio ($V_{40}/T_{150}$). For example, by taking into consideration the following items (c) to (e), these values can also be regulated to desired ranges.

(c) The comb-shaped polymer has such properties that viscous properties are hardly revealed in a low-temperature region. For that reason, when a proportion of the content of the comb-shaped polymer in the viscosity index improver (A) is increased, the value of the kinematic viscosity ($V_{40}$) that is a kinematic viscosity of the obtained lubricating oil composition in a low-temperature region becomes low, so that the ratio ($V_{40}/V_{150}$) is readily regulated to be a small value.

(d) Meanwhile, the comb-shaped polymer has such properties that even when shearing in a high-temperature region, it may maintain the viscosity of a certain degree or more without causing a viscosity lowering. For that reason, by increasing the proportion of the content of the comb-shaped polymer in the viscosity index improver (A), even when the total amount of the viscosity index improver (A) is relatively small, the value of the HTHS viscosity ($T_{150}$) is readily regulated high.

(e) As the comb-shaped polymer has a low molecular weight distribution (Mw/Mn), the aforementioned properties in a low-temperature region or high-temperature region are readily revealed, and there is a tendency that the HTHS viscosity ($T_{150}$) and the ratio ($V_{40}/T_{150}$) are readily regulated to the aforementioned ranges.

When the aforementioned items (a) to (e) are properly combined and taken into consideration, the values of the HTHS viscosity ($T_{150}$) and ratio ($V_{40}/T_{150}$) can be regulated. However, on the occasion of regulating these values, the aforementioned items (a) to (e) are merely exemplification to the bitter end. For example, it is also possible to regulate these values by properly considering the results of the Examples as described later without being limited to these items.

From the viewpoints of improvements of lubricating performance, viscosity characteristic, and fuel consumption reducing properties, an HTHS viscosity at 100° C. ($T_{100}$) of the lubricating oil composition according to the embodiment of the present invention is preferably 3.0 to 6.0 mPa·s, more preferably 3.5 to 5.8 mPa·s, still more preferably 4.0 to 5.6 mPa·s, and yet still more preferably 4.2 to 5.3 mPa·s.

In the lubricating oil composition according to the embodiment of the present invention, a ratio of the HTHS viscosity at 150° C. ($T_{150}$) and the HTHS viscosity at 100° C. ($T_{100}$) ($T_{150}/T_{100}$) is preferably 0.50 or more, more preferably 0.51 or more, still more preferably 0.53 or more, and yet still more preferably 0.54 or more from the viewpoints of improvements in viscosity characteristic at a low temperature and fuel consumption reducing properties.

From the viewpoints of improvements of lubricating performance, viscosity characteristic, and fuel consumption reducing properties, a kinematic viscosity at 40° C. ($V_{40}$) of the lubricating oil composition according to the embodiment of the present invention is preferably 10.0 to 40.0 $mm^2/s$, more preferably 15.0 to 38.0 $mm^2/s$, still more preferably 20.0 to 35.0 $mm^2/s$, yet still more preferably 22.0 to 32.0 $mm^2/s$, and even yet still more preferably 24.0 to 29.9 $mm^2/s$.

From the viewpoints of improvements of lubricating performance, viscosity characteristic, and fuel consumption reducing properties, a kinematic viscosity at 100° C. ($V_{100}$) of the lubricating oil composition according to the embodiment of the present invention is preferably 4.0 to 12.5 $mm^2/s$, more preferably 5.0 to 11.0 $mm^2/s$, still more preferably 5.5 to 10.0 $mm^2/s$, and yet still more preferably 6.0 to 9.3 $mm^2/s$.

From the viewpoints of suppressing a change of viscosity to be caused due to a change of temperature and improving the fuel consumption reducing properties, a viscosity index of the lubricating oil composition according to the embodiment of the present invention is preferably 140 or more, more preferably 155 or more, still more preferably 170 or more, and yet still more preferably 190 or more.

Though the lubricating oil composition according to the embodiment of the present invention includes the viscosity index improver (A) containing the comb-shaped polymer together with the base oil, it may further contain additives for lubricating oil, which are used for general lubricating oils, and so on within the range where the effects of the present invention are not impaired.

In the lubricating oil composition according to the embodiment of the present invention, the total content of the base oil and the viscosity index improver (A) is preferably 70 mass % or more, more preferably 75 mass % or more, still more preferably 80 mass % or more, yet still more preferably 85 mass % or more, and even yet still more preferably 90 mass % or more, and typically 100 mass % or less, preferably 99.9 mass % or less, and more preferably 99 mass % or less on a basis of the total amount (100 mass %) of the lubricating oil composition.

Each of the components contained in the lubricating oil composition according to the embodiment of the present invention is hereunder described.

<Base Oil>

The base oil that is contained in the lubricating oil composition according to the embodiment of the present invention may be either a mineral oil or a synthetic oil, and a mixed oil of a mineral oil and a synthetic oil may also be used.

Examples of the mineral oil include atmospheric residues obtained by subjecting a crude oil, such as a paraffin-based mineral oil, an intermediate base mineral oil, a naphthenic mineral oil, etc., to atmospheric distillation; distillates obtained by subjecting such an atmospheric residue to distillation under reduced pressure; mineral oils and waxes resulting from subjecting the distillate to one or more treatments of solvent deasphalting, solvent extraction, hydro-cracking, solvent dewaxing, catalytic dewaxing, hydrorefining, and the like; mineral oils obtained by isomerizing a wax (GTL wax (Gas to Liquids Wax)) produced by a Fischer-Tropsch process or the like; and the like.

Of those, a mineral oil and a wax having been subjected to one or more treatments of solvent deasphalting, solvent extraction, hydro-cracking, solvent dewaxing, catalytic dewaxing, hydrorefining, and the like are preferred; a mineral oil classified into Group 2 or Group 3 of the base stock categories of the API (American Petroleum Institute) is more preferred; and a mineral oil classified into the foregoing Group 3 is still more preferred.

Examples of the synthetic oil include poly-α-olefins, such as polybutene and an α-olefin homopolymer or copolymer (for example, a homopolymer or copolymer of an α-olefin having a carbon number of 8 to 14, such as an ethylene-α-olefin copolymer, etc.), etc.; various esters, such as a polyol ester, a dibasic acid ester, a phosphate ester, etc.; various ethers, such as a polyphenyl ether, etc.; a polyglycol; an alkyl benzene; an alkyl naphthalene; synthetic oils obtained by isomerizing a wax (GTL wax) produced by a Fischer-Tropsch process or the like; and the like.

Of those synthetic oils, poly-α-olefins are preferred.

As the base oil that is used in the embodiment of the present invention, from the viewpoint of oxidation stability of the base oil itself, at least one selected from a mineral oil classified into Group 2 or Group 3 of the base stock categories of the API (American Petroleum Institute) and a synthetic oil is preferred, and at least one selected from a mineral oil classified into the foregoing Group 3 and a poly-α-olefin is more preferred.

In the embodiment of the present invention, these base oils may be used alone or in combination of any two or more thereof.

A kinematic viscosity at 100° C. of the base oil that is used in the embodiment of the present invention is preferably 2.0 to 20.0 $mm^2/s$, more preferably 2.0 to 15.0 $mm^2/s$, still more preferably 2.0 to 10.0 $mm^2/s$, and yet still more preferably 2.0 to 7.0 $mm^2/s$.

When the kinematic viscosity at 100° C. of the base oil is 2.0 $mm^2/s$ or more, an evaporation loss is small, and hence, such is preferred. On the other hand, when the kinematic viscosity at 100° C. of the base oil is 20.0 $mm^2/s$ or less, a power loss to be caused due to viscous resistance is not so large, so that a fuel consumption improving effect is obtained, and hence, such is preferred.

From the viewpoint of providing a lubricating oil composition in which not only the change in viscosity to be caused due to a change in temperature is suppressed, but also the fuel consumption reducing properties are improved, a viscosity index of the base oil that is used in the embodiment of the present invention is preferably 80 or more, more preferably 90 or more, and still more preferably 100 or more.

In the lubricating oil composition according to the embodiment of the present invention, in the case of using a mixed oil composed of a combination of two or more base oils, it is preferred that the kinematic viscosity and the viscosity index of the mixed oil fall within the aforementioned ranges.

In the lubricating oil composition according to the embodiment of the present invention, the content of the base oil is preferably 55 mass % or more, more preferably 60 mass % or more, still more preferably 65 mass % or more, and yet still more preferably 70 mass % or more, and preferably 99 mass % or less, and more preferably 95 mass % or less on a basis of the total amount (100 mass %) of the lubricating oil composition.

<Viscosity Index Improver (A)>

The lubricating oil composition of the present invention includes a viscosity index improver (A) containing a comb-shaped polymer and having an SSI of 30 or less.

In the present invention, by using the aforementioned viscosity index improver (A), the fuel consumption reducing properties in a low-temperature region assuming the time of starting an engine can be improved while maintaining various properties, such as a viscosity, etc., in a high-temperature region assuming the time of high-speed operation of an engine favorable.

The viscosity index improve (A) that is used in the embodiment of the present invention may contain other resin component which is not corresponding to the comb-shaped polymer, or the unreacted raw materials and catalyst used at the time of synthesis of the comb-shaped polymer as well as a by-product, such as a resin component as formed at the time of synthesis, which is not corresponding to the comb-shaped polymer, etc., within the range where the effects of the present invention are not impaired.

In the present specification, the aforementioned "resin component" means a polymer having a weight average molecular weight (Mw) of 1,000 or more and having a fixed repeating unit.

Examples of the other resin component which is not corresponding to the comb-shaped polymer include polymers not corresponding to the comb-shaped polymer, such as a polymethacrylate, a dispersion type polymethacrylate, an olefin-based copolymer (for example, an ethylene-propylene copolymer, etc.), a dispersion type olefin-based copolymer, a styrene-based copolymer (for example, a styrene-diene copolymer, a styrene-isoprene copolymer, etc.), etc.

There is also a case where such other resin component is not contained as the viscosity index improver (A), and for example, so long as a polymethacrylate-based compound is concerned, it is contained as a general-purpose additive, such a pour-point depressant, etc.

However, in the lubricating oil composition according to the embodiment of the present invention, from the viewpoint of regulating the value of the SSI of the viscosity index improver and from the viewpoint of improving the fuel consumption reducing properties in a low-temperature region assuming the time of starting an engine, the content of the other resin component (particularly a polymethacrylate-based compound) which is not corresponding to the comb-shaped polymer is preferably small as far as possible.

From the aforementioned viewpoints, the content of the polymethacrylate-based compound which is not corresponding to the comb-shaped polymer is preferably 0 to 30 parts by mass, more preferably 0 to 25 parts by mass, still more preferably 0 to 20 parts by mass, and yet still more preferably 0 to 15 parts by mass based on 100 parts by mass of the comb-shaped polymer contained in the lubricating oil composition.

The content of the aforementioned by-product is preferably 10 mass % or less, more preferably 5 mass % or less, still more preferably 1 mass % or less, and yet still more preferably 0.1 mass % or less on a basis of the total amount (100 mass %) of the solid component in the viscosity index improver (A).

The aforementioned "solid component in the viscosity index improver (A)" means a component in which a diluent oil is eliminated from the viscosity index improver (A) and includes not only the comb-shaped polymer but also other resin component or by-product not corresponding to the aforementioned comb-shaped polymer.

The content of the comb-shaped polymer in the viscosity index improver (A) that is used in the embodiment of the present invention is preferably 60 to 100 mass %, more preferably 70 to 100 mass %, still more preferably 80 to 100 mass %, yet still more preferably 90 to 100 mass %, even yet still more preferably 95 to 100 mass %, and even still more preferably 99 to 100 mass % on a basis of the total amount (100 mass %) of the aforementioned solid component in the viscosity index improver (A).

The viscosity index improver (A) that is used in the embodiment of the present invention includes the comb-shaped polymer as the resin component. However, in general, taking into consideration handling properties and solubility in the base oil, in many cases, viscosity index improvers are put on the market in a state of a solution in which the solid component containing a resin, such as the comb-shaped polymer, etc., is dissolved with a diluent oil, such as a mineral oil, a synthetic oil, etc.

In the case where the viscosity index improver (A) that is used in the embodiment of the present invention is in a form of the aforementioned solution, the solid component concentration of the solution is typically 10 to 50 mass % on a basis of the total amount (100 mass %) of the solution.

In the lubricating oil composition according to the embodiment of the present invention, from the viewpoints of improving the viscosity characteristic and making the fuel consumption reducing properties in all of a high-temperature region and a low-temperature region favorable, the content of the viscosity index improver (A) is preferably 0.01 to 10.00 mass %, more preferably 0.05 to 8.00 mass %, still more preferably 0.10 to 6.50 mass %, yet still more preferably 0.50 to 5.00 mass %, and even yet still more preferably 0.90 to 4.00 mass % on a basis of the total amount (100 mass %) of the lubricating oil composition.

In the present specification, the aforementioned "content of the viscosity index improver (A)" is a solid component amount including the comb-shaped polymer and the aforementioned other resin component but not including the mass of the diluent oil.

In the present specification, the SSI means a shear stability index and expresses a percentage of viscosity lowering by shearing originated from the resin component in the viscosity index improver.

In the present specification, the SSI of the viscosity index improver (A) is a value as measured in conformity with ASTM D6278, and specifically, it is a value as calculated according to the following calculation formula (1).

$$SSI = \frac{Kv_0 - Kv_1}{Kv_0 - Kv_{oil}} \times 100 \quad (1)$$

In the formula (1), $Kv_0$ represents a value of kinematic viscosity at 100° C. of the viscosity index improver containing the resin component; and $Kv_1$ represents a value of kinematic viscosity at 100° C. measured after passing the foregoing viscosity index improver through a high-shear Bosch diesel injector for 30 cycles according to the procedures of ASTM D6278. $Kv_{oil}$ denotes a value of kinematic viscosity at 100° C. of a composition of the foregoing viscosity index improver and the diluent oil.

From the viewpoint of improving the fuel consumption reducing properties in a low-temperature region assuming the time of starting an engine, though the SSI of the viscosity index improver (A) that is used in the present invention is 30 or less, it is preferably 25 or less, more preferably 20 or less, still more preferably 15 or less, and yet still more preferably 10 or less.

When the SSI of the viscosity index improver (A) is more than 30, the fuel consumption reducing properties in a low-temperature region assuming the time of starting an engine tends to become insufficient. In addition, with respect to the obtained lubricating oil composition, a lowering of viscosity at a high temperature is brought with a lapse of time, so that wear or damage of the parts is liable to be generated.

Though a lower limit value of the SSI of the viscosity index improver (A) is not particularly limited, the SSI of the viscosity index improver (A) is typically 1 or more, and preferably 2 or more.

The value of the SSI of the viscosity index improver (A) varies with a structure of the resin component of the viscosity index improver (A). Specifically, there are the following tendencies, and by taking into consideration these items, the value of the SSI of the viscosity index improver (A) can be readily regulated. However, the following items are merely exemplification to the bitter end. For example, it is also possible to regulate the value of the SSI of the viscosity index improver (A) by properly considering the results of the Examples as described later.

- A value of the SSI of PMA that is generally used as a viscosity index improver, or the like tends to become high.
- As the molecular weight of the viscosity index improver is smaller, the SSI of the foregoing viscosity index improver tends to become lower.
- On the other hand, in the comb-shaped polymer that is used in the present invention, the value of the SSI tends to become low according to its comb-shaped structure. For that reason, when a content proportion of the comb-shaped polymer in the viscosity index improver (A) is increased, the value of the SSI of the viscosity index improver (A) tends to become low.
- As a content proportion of a comb-shaped polymer having a large content of a constituent unit (I) derived from a macromonomer (I') corresponding to a side chain of the comb-shaped polymer increases, the value of the SSI tends to become low.
- As a content proportion of a comb-shaped polymer having a high-molecular weight side chain increases, the value of the SSI tends to become low.

The "comb-shaped polymer" which the viscosity index improver (A) that is used in the embodiment of the present invention contains is hereunder described.

<Comb-Shaped Polymer>

The "comb-shaped polymer" which the viscosity index improver (A) that is used in the present invention refers to a polymer having a structure having a large number of trigeminal branch points from which a high-molecular weight side chain comes out in a main chain thereof.

As the comb-shaped polymer having such a structure, a polymer having at least a constituent unit (I) derived from a macromonomer (I') is preferred. This constituent unit (I) is corresponding to the aforementioned "high-molecular weight side chain".

In the present invention, the aforementioned "macromonomer" means a high-molecular weight monomer having a polymerizable functional group and is preferably a high-molecular weight monomer having a polymerizable functional group in an end thereof.

Though the comb-shaped polymer has a structure in which a distance between the trigeminal branch points of the main chain is long, and the main chain with high polarity readily comes into contact with the base oil, this main chain is hardly dissolved in the base oil in a low-temperature region. For that reason, in the comb-shaped polymer, in a low-temperature region, such properties that the viscosity hardly increases are revealed, and in the lubricating oil composition containing the comb-shaped polymer, the value of the kinematic viscosity ($V_{40}$) that is a kinematic viscosity in a low-temperature region readily becomes low.

Meanwhile, in the comb-shaped polymer, the main chain readily spreads in the base oil in a high-temperature region, and such properties that the viscosity readily increases are revealed, and the comb-shaped polymer has properties capable of maintaining the viscosity of a certain degree or more. For that reason, the value of the HTHS viscosity ($T_{150}$) of the lubricating oil composition containing the comb-shaped polymer readily becomes high.

A number average molecular weight (Mn) of the macromonomer (I') is preferably 200 or more, more preferably 500 or more, still more preferably 600 or more, and yet still more preferably 700 or more, and preferably 200,000 or less, more preferably 100,000 or less, still more preferably 50,000 or less, and yet still more preferably 20,000 or less.

Examples of the polymerizable functional group which the macromonomer (I') has include an acryloyl group ($CH_2$═CH—COO—), a methacryloyl group ($CH_2$═$CCH_3$—COO—), an ethenyl group ($CH_2$═CH—), a vinyl ether group ($CH_2$═CH—O—), an allyl group ($CH_2$═CH—$CH_2$—), an allyl ether group ($CH_2$═CH—$CH_2$—O—), a group represented by $CH_2$═CH—CONH—, a group represented by $CH_2$═$CCH_3$—CONH—, and the like.

The macromonomer (I') may also have at least one selected from repeating units represented by the following general formulae (i) to (iii) in addition to the aforementioned polymerizable functional groups.

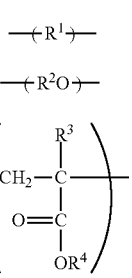

(i)

(ii)

(iiii)

In the general formula (i), $R^1$ represents a linear or branched chain alkylene group having a carbon number of 1 to 10, and specifically, examples thereof include a methylene group, an ethylene group, a 1,2-propylene group, a 1,3-propylene group, a 1,2-butylene group, a 1,3-butylene group, a 1,4-butylene group, a pentylene group, a hexylene group, a heptylene group, an octylene group, a nonylene group, a decylene group, an isopropyl group, an isobutyl group, a 2-ethylhexylene group, and the like.

In the general formula (ii), $R^2$ represents a linear or branched chain alkylene group having a carbon number of 2 to 4, and specifically, examples thereof include an ethylene group, a 1,2-propylene group, a 1,3-propylene group, a 1,2-butylene group, a 1,3-butylene group, a 1,4-butylene group, and the like.

In the general formula (iii), $R^3$ represents a hydrogen atom or a methyl group.

$R^4$ represents a linear or branched chain alkyl group having a carbon number of 1 to 10, and specifically, examples thereof include a methyl group, an ethyl group, a n-propyl group, a n-butyl group, a n-pentyl group, a n-hexyl group, a n-heptyl group, a n-octyl group, a n-nonyl group, a n-decyl group, an isopropyl group, an isobutyl group, a sec-butyl group, a t-butyl group, an isopentyl group, a t-pentyl group, an isohexyl group, a t-hexyl group, an isoheptyl group, a t-heptyl group, a 2-ethylhexyl group, an isooctyl group, an isononyl group, an isodecyl group, and the like.

In the case where the macromonomer (I') has a plurality of repeating units represented by each of the general formulae (i) to $R^1$, $R^2$, $R^3$, and $R^4$ may be each the same as or different from each other.

In the case where the macromonomer (I') is a copolymer having two or more repeating units selected from the general formulae (i) to (iii), the mode of the copolymer may be a block copolymer or may be a random copolymer.

The comb-shaped polymer that is used in the embodiment of the present invention may be a homopolymer composed of only the constituent unit (I) derived from one kind of the macromonomer (I') or may be a copolymer containing the constituent unit (I) derived from two or more kinds of the macromonomer (I').

In addition, the comb-shaped polymer that is used in the embodiment of the present invention may also be a copolymer containing the constituent unit (I) derived from the macromonomer (I') as well as a constituent unit (II) derived from other monomer (II') than the macromonomer (I').

As a specific structure of such a comb-shaped polymer, a copolymer having a side chain containing the constituent unit (I) derived from the macromonomer (I') relative to the main chain containing the constituent unit (II) derived from the monomer (II') is preferred.

In the comb-shaped polymer that is used in the present invention, as the content of the constituent unit (II) increases, a distance between the trigeminal branch points of the main chain having a high-molecular weight side chain derived from the macromonomer (I') becomes long. As a result, since the comb-shaped polymer is low in viscosity in a low-temperature region, the value of the kinematic viscosity ($V_{40}$) is readily regulated low, whereas it is high in viscosity in a high-temperature region, the value of the HTHS viscosity ($T_{150}$) is readily regulated high.

Examples of the monomer (II') include a monomer (a) represented by the following general formula (a1), an alkyl (meth)acrylate (b), a nitrogen atom-containing vinyl monomer (c), a hydroxyl group-containing vinyl monomer (d), a phosphorus atom-containing monomer (e), an aliphatic hydrocarbon-based vinyl monomer (f), an alicyclic hydrocarbon-based vinyl monomer (g), an aromatic hydrocarbon-based vinyl monomer (h), a vinyl ester (i), a vinyl ether (j), a vinyl ketone (k), an epoxy group-containing vinyl monomer (l), a halogen element-containing vinyl monomer (m), an ester of unsaturated polycarboxylic acid (n), a (di)alkyl fumarate (o), a (di)alkyl maleate (p), and the like.

As the monomer (II'), the monomers other than the aromatic hydrocarbon-based vinyl monomer (h) are preferred.

(Monomer (a) represented by the following general formula (a1))

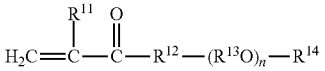

(a1)

In the general formula (a1), $R^{11}$ represents a hydrogen atom or a methyl group.

$R^{12}$ represents a single bond, a linear or branched alkylene group having a carbon number of 1 to 10, —O—, or —NH—.

$R^{13}$ represents a linear or branched alkylene group having a carbon number of 2 to 4. In addition, n represents an integer of 1 or more (preferably an integer of 1 to 20, and more preferably an integer of 1 to 5). In the case where n is an integer of 2 or more, plural $R^{13}$s may be the same as or different from each other, and furthermore, the $(R^{13}O)_n$ moiety may be either a random bond or a block bond.

$R^{14}$ represents a linear or branched alkyl group having a carbon number of 1 to 60 (preferably 10 to 50, and more preferably 20 to 40).

Specific groups of the aforementioned "linear or branched alkylene group having a carbon number of 1 to 10", "linear or branched alkylene group having a carbon number of 2 to 4", and "linear or branched alkyl group having a carbon number of 1 to 60" include the same groups as those exemplified in the descriptions regarding the aforementioned general formulae (i) to (iii).

(Alkyl (meth)acrylate (b))

Examples of the alkyl (meth)acrylate (b) include methyl (meth)acrylate, ethyl (meth)acrylate, n-propyl (meth)acrylate, isopropyl (meth)acrylate, n-butyl (meth)acrylate, t-butyl (meth)acrylate, pentyl (meth)acrylate, hexyl (meth)acrylate, 2-ethylhexyl (meth)acrylate, heptyl (meth)acrylate, 2-t-butylheptyl (meth)acrylate, octyl (meth)acrylate, 3-isopropylheptyl (meth)acrylate, and the like.

The carbon number of the alkyl group which the alkyl (meth)acrylate (b) has is preferably 1 to 30, more preferably 1 to 26, and still more preferably 1 to 10.

(Nitrogen Atom-Containing Vinyl Monomer (c))

Examples of the nitrogen atom-containing vinyl monomer (c) include an amide group-containing vinyl monomer (c1), a nitro group-containing vinyl monomer (c2), a primary amino group-containing vinyl monomer (c3), a secondary amino group-containing vinyl monomer (c4), a tertiary amino group-containing vinyl monomer (c5), a nitrile group-containing vinyl monomer (c6), and the like.

Examples of the amide group-containing vinyl monomer (c1) include (meth)acrylamide; monoalkylamino (meth) acrylamides, such as N-methyl (meth)acrylamide, N-ethyl (meth)acrylamide, N-isopropyl (meth)acrylamide, N-n- or isobutyl (meth)acrylamide, etc.; monoalkylaminoalkyl (meth)acrylamides, such as N-methylaminoethyl (meth) acrylamide, N-ethylaminoethyl (meth)acrylamide, N-isopropylamino-n-butyl (meth)acrylamide, N-n- or is obutylamino-n-butyl (meth)acrylamide, etc.; clialkylamino (meth)acrylamides, such as N,N-dimethyl (meth)acrylamide, N,N-diethyl (meth)acrylamide, N,N-diisopropyl (meth) acrylamide, N,N-di-n-butyl (meth)acrylamide, etc.; dialkylaminoalkyl (meth)acrylamides, such as N,N-climethylaminoethyl (meth)acrylamide, N,N-diethylaminoethyl (meth)acrylamide, N,N-climethylaminopropyl (meth)acrylamide, N,N-di-n-butylaminobutyl (meth)acrylamide, etc.; N-vinylcarboxylic acid amides, such as N-vinylformamide, N-vinylacetamide, N-vinyl-n- or isopropionylamide, N-vinylhydroxyacetamide, etc.; and the like.

Examples of the nitro group-containing monomer (c2) include 4-nitrostyrene and the like.

Examples of the primary amino group-containing vinyl monomer (c3) include alkenylamines having an alkenyl group having a carbon number of 3 to 6, such as (meth) allylamine, crotylamine, etc.; aminoalkyl (meth)acrylates having an alkyl group having a carbon number of 2 to 6, such as aminoethyl (meth)acrylate, etc.; and the like.

Examples of the secondary amino group-containing vinyl monomer (c4) include monoalkylaminoalkyl (meth)acrylates, such as t-butylaminoethyl (meth)acrylate, methylaminoethyl (meth)acrylate, etc.; dialkenylamines having a carbon number of 6 to 12, such as di(meth)allylamine, etc.; and the like.

Examples of the tertiary amino group-containing vinyl monomer (c5) include dialkylaminoalkyl (meth)acrylates, such as dimethylaminoethyl (meth)acrylate, diethylaminoethyl (meth)acrylate, etc.; alicyclic (meth)acrylates having a nitrogen atom, such as morpholinoethyl (meth)acrylate, etc.; aromatic vinyl-based monomers, such as diphenylamine (meth)acrylamide, N,N-dimethylaminostyrene, 4-vinylpyridine, 2-vinylpyridine, N-vinylpyrrole, N-vinylpyrrolidone, N-vinylthiopyrrolidone, etc.; hydrochlorides, sulfates, phosphates or lower alkyl (carbon number: 1 to 8) monocarboxylic acid (e.g., acetic acid, propionic acid, etc.) salts thereof; and the like.

Examples of the nitrile group-containing vinyl monomer (c6) include (meth)acrylonitrile and the like.

(Hydroxyl Group-Containing Vinyl Monomer (d))

Examples of the hydroxyl group-containing vinyl monomer (d) include a hydroxyl group-containing vinyl monomer (d1), a polyoxyalkylene chain-containing vinyl monomer (d2), and the like.

Examples of the hydroxyl group-containing vinyl monomer (d1) include hydroxyl group-containing aromatic vinyl monomers, such as p-hydroxystyrene; hydroxyalkyl (meth) acrylates having an alkyl group having a carbon number of 2 to 6, such as 2-hydroxyethyl (meth)acrylate, 2- or 3-hydroxypropyl (meth)acrylate, etc.; mono- or di-hydroxyalkyl-substituted (meth)acrylamides having an alkyl group having a carbon number of 1 to 4, such as N,N-dihydroxymethyl (meth)acrylamide, N,N-dihydroxypropyl (meth)acrylamide, N,N-di-2-hydroxybutyl (meth)acrylamide, etc.; vinyl alcohol; alkenols having a carbon number of 3 to 12, such as (meth)allyl alcohol, crotyl alcohol, isocrotyl alcohol, 1-octenol, 1-undecenol, etc.; alkene monools or alkene diols each having a carbon number of 4 to 12, such as 1-buten-3-ol, 2-buten-1-ol, 2-butene-1,4-diol, etc.; hydroxyalkyl alkenyl ethers having an alkyl group having a carbon number of 1 to 6 and an alkenyl group having a carbon number of 3 to 10, such as 2-hydroxyethyl propenyl ether, etc.; alkenyl ethers or (meth)acrylates of a polyhydric alcohol, such as glycerin, pentaerythritol, sorbitol, sorbitan, a sugar, sucrose, etc.; and the like.

Examples of the polyoxyalkylene chain-containing vinyl monomer (d2) include a polyoxyalkylene glycol (carbon number of the alkylene group: 2 to 4, degree of polymerization: 2 to 50), a polyoxyalkylene polyol (polyoxyalkylene ether of the aforementioned polyhydric alcohol (carbon number of the alkylene group: 2 to 4, degree of polymerization: 2 to 100)), a mono(meth)acrylate of an alkyl ether (carbon number: 1 to 4) of a polyoxyalkylene glycol or polyoxyalkylene polyol [e.g., polyethylene glycol (Mn: 100 to 300) mono(meth)acrylate, polypropylene glycol (Mn: 130 to 500) mono(meth)acrylate, methoxypolyethylene glycol (Mn: 110 to 310) (meth)acrylate, lauryl alcohol ethylene oxide adduct (2 to 30 mols) (meth)acrylate, mono(meth) acrylic acid polyoxyethylene (Mn: 150 to 230) sorbitan, etc.], and the like.

(Phosphorus Atom-Containing Monomer (e))

Examples of the phosphorus atom-containing monomer (e) include a phosphate ester group-containing monomer (e1), a phosphono group-containing monomer (e2), and the like.

Examples of the phosphate ester group-containing monomer (e1) include (meth)acryloyloxyalkyl phosphates having an alkyl group having a carbon number of 2 to 4, such as (meth)acryloyloxyethyl phosphate, (meth) acryloyloxyisopropyl phosphate, etc.; alkenyl phosphates having an alkenyl group having a carbon number of 2 to 12, such as vinyl phosphate, allyl phosphate, propenyl phosphate, isopropenyl phosphate, butenyl phosphate, pentenyl phosphate, octenyl phosphate, decenyl phosphate, dodecenyl phosphate, etc.; and the like.

Examples of the phosphono group-containing monomer (e2) include (meth)acryloyloxyalkyl phosphonates having an alkyl group having a carbon number of 2 to 4, such as (meth)acryloyloxyethyl phosphonate, etc; alkenyl phosphonates having an alkenyl group having a carbon number of 2 to 12, such as vinyl phosphonate, allyl phosphonate, octenyl phosphonate, etc.; and the like.

(Aliphatic Hydrocarbon-Based Vinyl Monomer (f))

Examples of the aliphatic hydrocarbon-based vinyl monomer (f) include alkenes having a carbon number of 2 to 20, such as ethylene, propylene, butene, isobutylene, pentene, heptene, diisobutylene, octene, dodecene, octadecene, etc.; alkadienes having a carbon number of 4 to 12, such as butadiene, isoprene, 1,4-pentadiene, 1,6-heptadiene, 1,7-octadiene, etc.; and the like.

The carbon number of the aliphatic hydrocarbon-based vinyl monomer (f) is preferably 2 to 30, more preferably 2 to 20, and still more preferably 2 to 12.

(Alicyclic Hydrocarbon-Based Vinyl Monomer (g))

Examples of the alicyclic hydrocarbon-based vinyl monomer (g) include cyclohexene, (di)cyclopentacliene, pinene, limonene, vinylcyclohexene, ethylidene bicycloheptene, and the like.

The carbon number of the alicyclic hydrocarbon-based vinyl monomer (g) is preferably 3 to 30, more preferably 3 to 20, and still more preferably 3 to 12.

(Aromatic Hydrocarbon-Based Vinyl Monomer (h))

Examples of the aromatic hydrocarbon-based vinyl monomer (h) include styrene, α-methylstyrene, α-ethylstyrene, vinyltoluene, 2,4-dimethylstyrene, 4-ethylstyrene, 4-isopropylstyrene, 4-butylstyrene, 4-phenylstyrene, 4-cyclohexylstyrene, 4-benzylstyrene, p-methylstyrene, monochlorostyrene, dichlorostyrene, tribromostyrene, tetrabromostyrene, 4-crotylbenzene, indene, 2-vinylnaphthalene, and the like.

The carbon number of the aromatic hydrocarbon-based vinyl monomer (h) is preferably 8 to 30, more preferably 8 to 20, and still more preferably 8 to 18.

(Vinyl Ester (i))

Examples of the vinyl ester (i) include vinyl esters of a saturated fatty acid having a carbon number of 2 to 12, such as vinyl acetate, vinyl propionate, vinyl butyrate, vinyl octanoate, etc.; and the like.

(Vinyl Ether (j))

Examples of the vinyl ether (j) include alkyl vinyl ethers having a carbon number of 1 to 12, such as methyl vinyl ether, ethyl vinyl ether, propyl vinyl ether, butyl vinyl ether, 2-ethylhexyl vinyl ether, etc.; aryl vinyl ethers having a carbon number of 6 to 12, such as phenyl vinyl ether, etc.; alkoxyalkyl vinyl ethers having a carbon number of 1 to 12, such as vinyl-2-methoxyethyl ether, vinyl-2-butoxyethyl ether, etc.; and the like.

(Vinyl Ketone (k))

Examples of the vinyl ketone (k) include alkyl vinyl ketones having a carbon number of 1 to 8, such as methyl vinyl ketone, ethyl vinyl ketone, etc.; aryl vinyl ketones having a carbon number of 6 to 12, such as phenyl vinyl ketone, etc.; and the like.

(Epoxy Group-Containing Vinyl Monomer (l))

Examples of the epoxy group-containing vinyl monomer (D include glycidyl (meth)acrylate, glycidyl (meth)allyl ether, and the like.

(Halogen Element-Containing Vinyl Monomer (m))

Examples of the halogen element-containing vinyl monomer (m) include vinyl chloride, vinyl bromide, vinylidene chloride, (meth)allyl chloride, a halogenated styrene (e.g., dichlorostyrene, etc.), and the like.

(Ester of Unsaturated Polycarboxylic Acid (n))

Examples of the ester of unsaturated polycarboxylic acid (n) include an alkyl ester of an unsaturated polycarboxylic acid, a cycloalkyl ester of an unsaturated polycarboxylic acid, an aralkyl ester of an unsaturated polycarboxylic acid, and the like; and examples of the unsaturated carboxylic acid include maleic acid, fumaric acid, itaconic acid, and the like.

((Di)alkyl Fumarate (o))

Examples of the (d)alkyl fumarate (o) include monomethyl fumarate, climethyl fumarate, monoethyl fumarate, diethyl fumarate, methylethyl fumarate, monobutyl fumarate, dibutyl fumarate, clipentyl fumarate, clihexyl fumarate, and the like.

((Di)alkyl Maleate (p))

Examples of the (di)alkyl maleate (p) include monomethyl maleate, climethyl maleate, monoethyl maleate, diethyl maleate, methylethyl maleate, monobutyl maleate, dibutyl maleate, and the like.

From the viewpoint of making the fuel consumption reducing properties in a low-temperature region assuming the time of starting an engine favorable, a weight average molecular weight (Mw) of the comb-shaped polymer that is used in the embodiment of the present invention is preferably 10,000 to 1,000,000, more preferably 30,000 to 700,000, still more preferably 60,000 to 600,000, and yet still more preferably 100,000 to 550,000.

From the viewpoint of making the fuel consumption reducing properties in a low-temperature region assuming the time of starting an engine favorable, a molecular weight distribution (Mw/Mn) of the comb-shaped polymer that is used in the embodiment of the present invention is preferably 6.00 or less, more preferably 4.00 or less, still more preferably 3.00 or less, yet still more preferably 2.00 or less, and especially preferably less than 2.00.

As the molecular weight distribution of the comb-shaped polymer is small, the aforementioned properties of the comb-shaped polymer in a low-temperature region and a high-temperature region are readily revealed, and the HTHS viscosity ($T_{150}$) and the aforementioned ratio ($V_{40}/T_{150}$) are readily regulated to the aforementioned ranges. For that reason, the lubricating oil composition including the comb-shaped polymer having a small molecular weight distribution may become one in which the fuel consumption reducing properties in a low-temperature region assuming the time of starting an engine is more improved.

Though a lower limit value of the molecular weight distribution of the comb-shaped polymer is not particularly limited, the molecular weight distribution (Mw/Mn) of the comb-shaped polymer is typically 1.01 or more, preferably 1.05 or more, and more preferably 1.10 or more.

In the lubricating oil composition according to the embodiment of the present invention, from the viewpoints of regulating the HTHS viscosity ($T_{150}$) and the aforementioned ratio ($V_{40}/T_{150}$) to the aforementioned ranges and making the fuel consumption reducing properties in a low-temperature region assuming the time of starting an engine favorable, the content of the comb-shaped polymer is preferably 0.01 to 10.00 mass %, more preferably 0.05 to 8.00 mass %, still more preferably 0.10 to 6.50 mass %, yet still more preferably 0.50 to 5.00 mass %, and even yet still more preferably 0.90 to 4.00 mass % on a basis of the total amount (100 mass %) of the lubricating oil composition.

In the present specification, the aforementioned "content of the comb-shaped polymer" does not include the mass of a diluent oil or the like, which is possibly contained together with the comb-shaped polymer.

<Additive for Lubricating Oil>

The lubricating oil composition according to the embodiment of the present invention may further contain an additive for lubricating oil other than the viscosity index improver, if desired within the range where the effects of the present invention are not impaired.

Examples of the foregoing additive for lubricating oil include a metal-based detergent, a dispersant, an anti-wear agent, an extreme pressure agent, an antioxidant, a pour-point depressant, an anti-foaming agent, a friction modifier, a rust inhibitor, a metal deactivator, and the like.

Among those, it is preferred that the lubricating oil composition according to the embodiment of the present invention contains at least one additive for lubricating oil selected from a metal-based detergent, a dispersant, an anti-wear agent, an extreme pressure agent, an antioxidant, a pour-point depressant, and an anti-foaming agent.

As the additive for lubricating oil, a commercially available additive package that is a mixture containing plural additives in conformity with the API/ILSAC standards, the SN/GF-5 standards, or the like may also be used.

Though the content of each of these additives for lubricating oil can be properly regulated within the range where the effects of the present invention are not impaired, it is typically 0.001 to 15 mass %, preferably 0.005 to 10 mass %, and more preferably 0.01 to 5 mass % on a basis of the total amount (100 mass %) of the lubricating oil composition.

In the lubricating oil composition according to the embodiment of the present invention, the total content of these additives for lubricating oil is preferably 30 mass % or less, more preferably 25 mass % or less, still more preferably 20 mass % or less, and yet still more preferably 15 mass % or less on a basis of the total amount (100 mass %) of the lubricating oil composition.

(Metal-Based Detergent)

Examples of the metal-based detergent include organic metal-based compounds containing a metal atom selected from an alkali metal atom and an alkaline earth metal atom, and specifically, examples thereof include a metal salicylate, a metal phenate, a metal sulfonate, and the like.

From the viewpoint of improving the detergency at a high temperature, the metal atom that is contained in the metal-based detergent is preferably a sodium atom, a calcium atom, a magnesium atom, or a barium atom, and more preferably a calcium atom.

The metal salicylate is preferably a compound represented by the following general formula (1); the metal phenate is preferably a compound represented by the following general formula (2); and the metal sulfonate is preferably a compound represented by the following general formula (3).

(1)

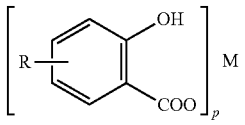

(2)

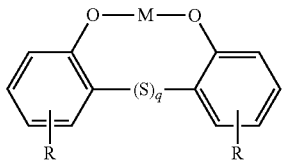

(3)

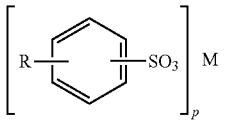

In the general formulae (1) to (3), M is a metal atom selected from an alkali metal atom and an alkaline earth metal atom, and preferably a sodium atom (Na), a calcium atom (Ca), a magnesium atom (Mg), or a barium atom (Ba), with a calcium atom (Ca) being more preferred. p is a valence of M, and 1 or 2. q is an integer of 0 or more, and preferably an integer of 0 to 3. R is a hydrogen atom or a hydrocarbon group having a carbon number of 1 to 18.

Examples of the hydrocarbon group that may be selected as R include an alkyl group having a carbon number of 1 to 18, an alkenyl group having a carbon number of 1 to 18, a cycloalkyl group having a ring-forming carbon number of 3 to 18, an aryl group having a ring-forming carbon number of 6 to 18, an alkylaryl group having a carbon number of 7 to 18, an arylalkyl group having a carbon number of 7 to 18, and the like.

The metal-based detergent that is used in the embodiment of the present invention may be used alone or in combination of any two or more thereof.

Among those, from the viewpoint of improving the detergency at a high temperature and the viewpoint of solubility in the base oil, the metal-based detergent is preferably at least one selected from calcium salicylate, calcium phenate, and calcium sulfonate.

The metal-based detergent that is used in the embodiment of the present invention may be any of a neutral salt, a basic salt, an overbased salt, and a mixture thereof.

In the case where the metal-based detergent that is used in the embodiment of the present invention is a basic salt or an overbased salt, a base number of the metal-based detergent is preferably 10 to 600 mgKOH/g, and more preferably 20 to 500 mgKOH/g.

In the present specification, the "base number" means a base number as measured by the perchloric acid method in conformity with JIS K2501, Section 7: "Petroleum products and lubricating oils-neutralization number test method".

(Dispersant)

Examples of the dispersant include a succinimide, benzylamine, a succinic ester, a boron-modified product thereof, and the like.

Examples of the succinimide include monoimides or bisimides of a succinic acid having a polyalkenyl group, such as a polybutenyl group, etc., and having a molecular weight of 300 to 4,000 and a polyethylenepolyamine, such as ethylenediamine, diethylenetriamine, triethylenetetr amine, tetraethylenepentamine, pentaethylenehexamine, etc., or a boronic acid-modified product thereof; Mannich reaction products of phenol, formaldehyde, and a polyethylenepolyamine, having a polyalkenyl group; and the like.

(Anti-Wear Agent)

Examples of the anti-wear agent or the extreme pressure agent include sulfur-containing compounds, such as zinc clialkyklithiophosphate (ZnDTP), zinc phosphate, zinc dithiocarbamate, molybdenum dithiocarbamate, molybdenum clithiophosphate, disulfides, sulfurized olefins, sulfurized oils and fats, sulfurized esters, thiocarbonates, thiocarbamates, polysulfides, etc.; phosphorus-containing compounds, such as phosphite esters, phosphate esters, phosphonate esters, and amine salts or metal salts thereof, etc.; and sulfur- and phosphorus-containing anti-wear agents, such as thiophosphite esters, thiophosphate esters, thiophosphonate esters, and amine salts or metal salts thereof, etc.

Of those, zinc clialkyldithiophosphate (ZnDTP) is preferred.

(Extreme Pressure Agent)

Examples of the extreme pressure agent include sulfur-based extreme pressure agents, such as sulfides, sulfoxides, sulfones, thiophosphinates, etc.; halogen-based extreme pressure agents, such as a chlorinated hydrocarbon, etc.; organic metal-based extreme pressure agents; and the like.

(Antioxidant)

As the antioxidant, an arbitrary material can be properly selected and used among known antioxidants that have hitherto been used as an antioxidant for a lubricating oil, and examples thereof include an amine-based antioxidant, a phenol-based antioxidant, a molybdenum-based antioxidant, a sulfur-based antioxidant, a phosphorus-based antioxidant, and the like.

Examples of the amine-based antioxidant include diphenylamine-based antioxidants, such as diphenylamine, an alkylated diphenylamine having an alkyl group having a carbon number of 3 to 20, etc.; naphthylamine-based antioxidants, such as α-naphthylamine, a $C_3$-$C_{20}$-alkyl-substituted phenyl-α-naphthylamine, etc.; and the like.

Examples of the phenol-based antioxidant include monophenol-based antioxidants, such as 2,6-di-tert-butyl-4-methylphenol, 2,6-di-tert-butyl-4-ethylphenol, octadecyl-3-(3,5-di-tert-butyl-4-hydroxyphenynpropionate, etc.; diphenol-based antioxidants, such as 4,4'-methylenebis(2,6-di-tert-butylphenol), 2,2'-methylenebis(4-ethyl-6-tert-butylphenol), etc.; hindered phenol-based antioxidants; and the like.

Examples of the molybdenum-based antioxidant include a molybdenum amine complex resulting from a reaction of molybdenum trioxide and/or molybdic acid and an amine compound; and the like.

Examples of the sulfur-based antioxidant include dilauryl-3,3'-thiodipropionate and the like.

Examples of the phosphorus-based antioxidant include a phosphite and the like.

Though these antioxidants may be used alone or in combination of any two or more thereof, in general, the use of a combination of any two or more thereof is preferred.

(Pour-Point Depressant)

Examples of the pour-point depressant include an ethylene-vinyl acetate copolymer, a condensate of a chlorinated paraffin and naphthalene, a condensate of a chlorinated paraffin and phenol, a polymethacrylate, a polyalkylstyrene, and the like.

(Anti-Foaming Agent)

Examples of the anti-foaming agent include silicone oil, fluorosilicone oil, a fluoroalkyl ether, and the like.

(Friction Modifier)

Examples of the friction modifier include molybdenum-based friction modifiers, such as molybdenum clithiocarbamate (MoDTC), molybdenum dithiophosphate (MoDTP), an amine salt of molybdic acid, etc.; ashless friction modifiers having at least one alkyl group or alkenyl group having a carbon number of 6 to 30, such as an aliphatic amine, a fatty acid ester, a fatty acid amide, a fatty acid, an aliphatic alcohol, an aliphatic ether, etc.; and the like.

(Rust Inhibitor)

Examples of the rust inhibitor include a petroleum sulfonate, an alkylbenzene sulfonate, dinonylnaphthalene sulfonate, an alkenylsuccinic ester, a polyhydric alcohol ester, and the like.

(Metal Deactivator)

Examples of the metal deactivator include a benzotriazole-based compound, a tolyltriazole-based compound, a thiadiazole-based compound, an imidazole-based compound, a pyrimidine-based compound, and the like.

[Application of Lubricating Oil Composition]

The lubricating oil composition of the present invention is excellent in fuel consumption reducing properties in a low-temperature region assuming the time of starting an engine while making various properties, such as a viscosity in a high-temperature region assuming the time of high-speed operation of an engine, etc., favorable.

For that reason, an engine filled with the lubricating oil composition of the present invention may become excellent in fuel consumption reducing properties not only at the time of high-speed operation but also at the time of use in a low-temperature region at the time of starting an engine. Though the foregoing engine is not particularly limited, it is suitably an engine for automobile.

For that reason, the present invention also provides a use method of a lubricating oil composition including using the aforementioned lubricating oil composition of the present invention in a low-temperature region at 10 to 60° C.

The temperature in a low-temperature region is the temperature range assuming the time of starting an engine, and it is typically 10 to 60° C., and preferably 20 to 60° C.

Though the lubricating oil composition according to the embodiment of the present invention is suitably applied as an engine oil for automobile, it may also be adopted for other applications.

Examples of other applications which may be considered with respect to the lubricating oil composition according to the embodiment of the present invention include a power stirring oil, an automatic transmission fluid (ATF), a continuously variable transmission fluid (CVTF), a hydraulic fluid, a turbine oil, a compressor oil, a lubricating oil for machine tool, a cutting oil, a gear oil, a fluid bearing oil, a rolling bearing oil, and the like.

[Method for Producing Lubricating Oil Composition]

The present invention also provides a method for producing a lubricating oil composition including the following step (I).

Step (I): A step of blending a base oil with a viscosity index improver (A) containing a comb-shaped polymer and having an SSI (shear stability index) of 30 or less, thereby preparing a lubricating oil composition such that an HTHS viscosity (high temperature high shear viscosity) at 150° C. ($T_{150}$) is 1.6 to 2.9 mPa·s, and a ratio of a kinematic viscosity at 40° C. ($V_{40}$) [$mm^2/s$] to the HTHS viscosity at 150° C. ($T_{150}$) [mPa·s] ($V_{40}/T_{150}$) is 12.4 or less.

In the step (I), the base oil and the component (A) to be blended are those as described above, and the suitable components and contents of the respective components are also the same.

In addition, in the present step, the aforementioned other additives for lubricating oil than the base oil and the component (A), and the like may also be blended.

The component (A) may be blended in a form of a solution having the resin component containing the comb-shaped polymer dissolved in a diluent oil. A solid component concentration of the solution is typically 10 to 50 mass %.

In the embodiment of the present invention, in the case where the component (A) is blended in a form of a solution of the viscosity index improver (A) having a solid component concentration of 10 to 50 mass %, the blending amount of the solution is preferably 0.1 to 30 mass %, more preferably 1 to 25 mass %, and still more preferably 2 to 20 mass % on the total amount (100 mass %) of the lubricating oil composition.

Besides the component (A), the aforementioned additives for lubricating oil may also be blended after adding a diluent oil and so on to form a solution (dispersion).

It is preferred that after blending the respective components, the resulting blend is stirred and uniformly dispersed by a known method.

Lubricating oil compositions obtained in the case where after blending the respective components, a part of the components denatures, or two of the components react with each other to form another component, fall within the technical scope of the present invention.

EXAMPLES

The present invention is hereunder described in more detail by reference to Examples, but it should be construed that the present invention is by no means limited by these Examples. The following various physical properties were measured and evaluated by the following methods.

(1) Weight Average Molecular Weight (Mw) and Number Average Molecular Weight (Mn):

Using a gel permeation chromatograph apparatus ("1260 Model HPLC", manufactured by Agilent), the measurement was performed under the following conditions, and a value as converted into standard polystyrene was adopted.

(Measuring Conditions)

Column: One in which two of "Shodex LF404" are successively connected to each other Column temperature: 35° C.

Developing solvent: Chloroform

Flow rate: 0.3 mL/min (2) SSI (Shear Stability Index):

The measurement was performed in conformity with ASTM D6278. Specifically, with respect to a viscosity index improver as a measuring object, each of the values of $Kv_0$, $Kv_1$, and $Kv_{oil}$ in the aforementioned calculation formula (1) was measured and calculated according to the foregoing calculation formula (1).

(3) Kinematic Viscosities at 40° C. and 100° C.:

The measurement was performed in conformity with JIS K2283.

(4) Viscosity Index:

The measurement was performed in conformity with JIS K2283.

(5) HTHS Viscosity (High Temperature High Shear Viscosity) at 100° C. and 150° C.:

A viscosity after shearing a lubricating oil composition as a measuring object at 100° C. or 150° C. and at a shear rate of $10^6$/s was measured in conformity with ASTM D4741.

(6) Torque Reduction:

A main shaft of an SOHC (single overhead camshaft) engine having a displacement of 1.5 L was driven by a motor, and on that occasion, a torque applied to the main shaft was measured. The number of revolutions of the main shaft was 1,500 rpm, and an engine oil temperature and a water temperature were set to 40° C., respectively.

In Examples 1 to 8 and Comparative Examples 1 and 2, a measured value of a torque when using a lubricating oil composition of Comparative Example 1 was made as a basis, and in Examples 9 to 16 and Comparative Examples 3 and 4, a measured value of a torque when using a lubricating oil composition of Comparative Example 3 was made as a basis, and a torque reduction (%) was calculated according to the following equation.

[Torque reduction] (%)={([Measured value of torque of the lubricating oil composition as an evaluation object]−[Measured value of torque of the lubricating oil composition of Comparative Example 1 or 3])/[Measured value of torque of the lubricating oil composition of Comparative Example 1 or 3]}×100

It is meant that as the value of the numerical value is large, the motoring torque is improved, and the fuel consumption reducing properties are high.

Details of each of the components of the lubricating oil compositions prepared in the present Examples and Comparative Examples are as follows.

<Base Oil>

"100N mineral oil"=kinematic viscosity at 40° C.: 17.8 $mm^2$/s, kinematic viscosity at 100° C.: 4.07 $mm^2$/s, viscosity index: 131, density: 0.824 g/$cm^3$ "70N mineral oil"=kinematic viscosity at 40° C.: 12.5 $mm^2$/s, kinematic viscosity at 100° C.: 3.12 $mm^2$/s, viscosity index: 110, density: 0.832 g/$cm^3$ <Viscosity Index Improver>

"Viscosity index improver-A"=A viscosity index improver including, as a main resin component, a comb-shaped polymer (Mw: 250,000, Mw/Mn: 2.08) having at least a constituent unit derived from a macromonomer having an Mn of 500 or more, and having a main resin component concentration of 19 mass % and an SSI of 3.

"Viscosity index improver-B"=A viscosity index improver including, as a main resin component, a comb-shaped polymer (Mw: 420,000, Mw/Mn: 5.92) having at least a constituent unit derived from a macromonomer having an Mn of 500 or more, and having a main resin component concentration of 19 mass % and an SSI of 5.

"Viscosity index improver-C"=A viscosity index improver including, as a main resin component, a comb-shaped polymer (Mw: 330,000, Mw/Mn: 2.00 or more) having at least a constituent unit derived from a macromonomer having an Mn of 500 or more, and having a main resin component concentration of 25 mass % and an SSI of 5.

"Viscosity index improver-D"=A viscosity index improver including, as a main resin component, a comb-shaped polymer (Mw: 440,000, Mw/Mn: 2.00 or more) having at least a constituent unit derived from a macromonomer having an Mn of 500 or more, and having a main resin component concentration of 25 mass % and an SSI of 8.

"Viscosity index improver-E"=A viscosity index improver including, as a main resin component, a comb-shaped polymer (Mw: 480,000, Mw/Mn: 2.00 or more) having at least a constituent unit derived from a macromonomer having an Mn of 500 or more, and having a main resin component concentration of 25 mass % and an SSI of 10.

"Viscosity index improver-F"=A viscosity index improver including, as a main resin component, a comb-shaped polymer (Mw: 360,000, Mw/Mn: less than 2.00) having at least a constituent unit derived from a macromonomer having an Mn of 500 or more, and having a main resin component concentration of 23 mass % and an SSI of 4.

"Viscosity index improver-G"=A viscosity index improver including, as a main resin component, a comb-shaped polymer (Mw: 410,000, Mw/Mn: 1.78) having at least a constituent unit derived from a macromonomer having an Mn of 500 or more, and having a main resin component concentration of 23 mass % and an SSI of 5.

"Viscosity index improver-H"=A viscosity index improver including, as a main resin component, a comb-shaped polymer (Mw: 480,000, Mw/Mn: 1.92) having at least a constituent unit derived from a macromonomer having an Mn of 500 or more, and having a main resin component concentration of 23 mass % and an SSI of 7.

"Viscosity index improver-I"=A viscosity index improver including, as a main resin component, polymethacrylate (PMA) (Mw: 510,000, Mw/Mn: 3.19) and having a main resin component concentration of 19 mass % and an SSI of 30.

"Viscosity index improver-J"=A viscosity index improver including, as a main resin component, polymethacrylate (PMA) (Mw: 380,000, Mw/Mn: 2.71) and having a main resin component concentration of 19 mass % and an SSI of 30.

<Pour-Point Depressant>

"PMA-based pour-point depressant"=A polymethacrylate-based pour-point depressant having an Mn of 62,000.

<Various Additives>

Additive package for engine oil: An additive package in conformity with the API/ILSAC standards and the SN/GF-5 standards and containing the following various additives.

Metal-based detergent: Overbased calcium salicylate

Dispersant: High-molecular weight bisimide and boron-modified monoimide

Anti-wear agent: Primary ZnDTP and secondary ZnDTP

Antioxidant: Diphenylamine-based antioxidant, hindered phenol-based antioxidant, and molybdenum-based antioxidant Anti-foaming agent: Silicone-based anti-foaming agent Examples 1 to 8 and Comparative Examples 1 to 2

The base oil, the viscosity index improver, the pour-point depressant, and the additive package for engine oil of the types and the blending amounts shown in Table 1 were blended, thereby preparing lubricating oil compositions whose SAE viscosity grade was "0W-20". The blending amount of each of the "viscosity index improver-A to viscosity index improver-K" in Table 1 is an amount including not only the comb-shaped polymer or PMA as a main resin component but also the diluent oil and the like.

Then, with respect to the prepared lubricating oil compositions, the kinematic viscosities at 40° C. and 100° C., the viscosity index, the HTHS viscosities at 100° C. and 150° C., and the torque reduction (on a basis of Comparative Example 1) were measured, respectively according to the aforementioned measurement methods. The results are shown in Table 1.

Examples 9 to 16 and Comparative Examples 3 to 4

The base oil, the viscosity index improver, the pour-point depressant, and the additive package for engine oil of the types and the blending amounts shown in Table 2 were blended, thereby preparing lubricating oil compositions whose SAE viscosity grade was "0W-16". The blending amount of each of the "viscosity index improver-A to viscosity index improver-K" in Table 2 is an amount including not only the comb-shaped polymer or PMA as a main resin component but also the diluent oil and the like.

Then, with respect to the prepared lubricating oil compositions, the kinematic viscosities at 40° C. and 100° C., the viscosity index, the HTHS viscosities at 100° C. and 150° C., and the torque reduction (on a basis of Comparative Example 3) were measured, respectively according to the aforementioned measurement methods. The results are shown in Table 2.

TABLE 1

| | | | Example 1 | Example 2 | Example 3 | Example 4 | Example 5 | Example 6 | Example 7 | Example 8 | Comparative Example 1 | Comparative Example 2 |
|---|---|---|---|---|---|---|---|---|---|---|---|---|
| Composition (mass %) | 100N mineral oil | | 73.46 | 74.96 | 74.76 | 75.86 | 75.16 | 74.06 | 74.16 | 74.26 | 72.96 | 70.46 |
| | 70N mineral oil | | 5.00 | 5.00 | 5.00 | 5.00 | 5.00 | 5.00 | 5.00 | 5.00 | 5.00 | 5.00 |
| | Viscosity index improver-A (containing 19 wt % of comb-shaped polymer, SSI = 3) | | 9.40 | | | | | | | | | |
| | Viscosity index improver-B (containing 19 wt % of comb-shaped polymer, SSI = 5) | | | 7.90 | | | | | | | | |
| | Viscosity index improver-C (containing 25 wt % of comb-shaped polymer, SSI = 5) | | | | 8.10 | | | | | | | |
| | Viscosity index improver-D (containing 25 wt % of comb-shaped polymer, SSI = 8) | | | | | 7.00 | | | | | | |
| | Viscosity index improver-E (containing 25 wt % of comb-shaped polymer, SSI = 10) | | | | | | 7.70 | | | | | |
| | Viscosity index improver-F (containing 23 wt % of comb-shaped polymer, SSI = 4) | | | | | | | 8.80 | | | | |
| | Viscosity index improver-G (containing 23 wt % of comb-shaped polymer, SSI = 5) | | | | | | | | 8.70 | | | |
| | Viscosity index improver-H (containing 23 wt % of comb-shaped polymer, SSI = 7) | | | | | | | | | 8.60 | | |
| | Viscosity index improver-I (containing 19 wt % of PMA, SSI = 30) | | | | | | | | | | 9.90 | |
| | Viscosity index improver-J (containing 19 wt % of PMA, SSI = 30) | | | | | | | | | | | 12.40 |
| | PMA-based pour-point depressant | | 0.20 | 0.20 | 0.20 | 0.20 | 0.20 | 0.20 | 0.20 | 0.20 | 0.20 | 0.20 |
| | Additive package for engine oil | | 11.94 | 11.94 | 11.94 | 11.94 | 11.94 | 11.94 | 11.94 | 11.94 | 11.94 | 11.94 |
| | Total amount | | 100.00 | 100.00 | 100.00 | 100.00 | 100.00 | 100.00 | 100.00 | 100.00 | 100.00 | 100.00 |
| | Content of comb-shaped polymer or PMA (mass %) (*) | | 1.79 | 1.50 | 2.03 | 1.75 | 1.93 | 2.02 | 2.00 | 1.98 | 1.88 | 2.36 |
| Properties | Kinematic viscosity at 40° C. ($V_{40}$) | $mm^2/s$ | 29.8 | 29.0 | 28.9 | 28.6 | 28.6 | 28.1 | 28.0 | 27.8 | 33.6 | 32.7 |
| | Kinematic viscosity at 100° C. ($V_{100}$) | $mm^2/s$ | 6.77 | 7.32 | 7.41 | 7.66 | 7.76 | 7.24 | 7.27 | 7.38 | 8.23 | 7.82 |
| | Viscosity index | — | 196 | 236 | 238 | 250 | 220 | 239 | 240 | 247 | 235 | 224 |
| | HTHS viscosity at 100° C. ($T_{100}$) | mPa · s | 5.02 | 4.81 | 4.92 | 4.83 | 4.77 | 4.68 | 4.67 | 4.65 | 4.65 | 4.64 |
| | HTHS viscosity at 150° C. ($T_{150}$) | mPa · s | 2.59 | 2.58 | 2.60 | 2.60 | 2.60 | 2.60 | 2.60 | 2.60 | 2.63 | 2.61 |
| | $V_{40}/T_{150}$ | — | 11.5 | 11.2 | 11.1 | 11.0 | 11.0 | 10.8 | 10.8 | 10.7 | 12.8 | 12.5 |
| | Torque reduction: 1.5 L Gasoline engine at 1,500 rpm and at oil temperature of 40° C. | % | 1.18 | 1.48 | 1.18 | 1.29 | 1.39 | 2.19 | 2.22 | 2.22 | 0.00 (Basis) | 0.59 |

(*): The content of the comb-shaped polymer or PMA relative to the total amount (100 mass %) of the prepared lubricating oil composition is expressed.

TABLE 2

| | | Example 9 | Example 10 | Example 11 | Example 12 | Example 13 | Example 14 | Example 15 | Example 16 | Comparative Example 3 | Comparative Example 4 |
|---|---|---|---|---|---|---|---|---|---|---|---|
| Composition (mass %) | 100N mineral oil | 77.06 | 78.56 | 77.86 | 78.26 | 78.06 | 77.26 | 77.46 | 77.36 | 77.46 | 76.16 |
| | 70N mineral oil | 5.00 | 5.00 | 5.00 | 5.00 | 5.00 | 5.00 | 5.00 | 5.00 | 5.00 | 5.00 |
| | Viscosity index improver-A (containing 19 wt % of comb-shaped polymer, SSI = 3) | | 5.80 | | | | | | | | |

TABLE 2-continued

| | | | Example 9 | Example 10 | Example 11 | Example 12 | Example 13 | Example 14 | Example 15 | Example 16 | Comparative Example 3 | Comparative Example 4 |
|---|---|---|---|---|---|---|---|---|---|---|---|---|
| | Viscosity index improver-B (containing 19 wt % of comb-shaped polymer, SSI = 5) | | | 4.30 | | | | | | | | |
| | Viscosity index improver-C (containing 25 wt % of comb-shaped polymer, SSI = 5) | | | | 5.00 | | | | | | | |
| | Viscosity index improver-D (containing 25 wt % of comb-shaped polymer, SSI = 8) | | | | | 4.60 | | | | | | |
| | Viscosity index improver-E (containing 25 wt % of comb-shaped polymer, SSI = 10) | | | | | | 4.80 | | | | | |
| | Viscosity index improver-F (containing 23 wt % of comb-shaped polymer, SSI = 4) | | | | | | | 5.60 | | | | |
| | Viscosity index improver-G (containing 23 wt % of comb-shaped polymer, SSI = 5) | | | | | | | | 5.40 | | | |
| | Viscosity index improver-H (containing 23 wt % of comb-shaped polymer, SSI = 7) | | | | | | | | | 5.50 | | |
| | Viscosity index improver-I (containing 19 wt % of PMA, SSI = 30) | | | | | | | | | | 5.40 | |
| | Viscosity index improver-J (containing 19 wt % of PMA, SSI = 30) | | | | | | | | | | | 6.70 |
| | PMA-based pour-point depressant | | 0.20 | 0.20 | 0.20 | 0.20 | 0.20 | 0.20 | 0.20 | 0.20 | 0.20 | 0.20 |
| | Additive package for engine oil | | 11.94 | 11.94 | 11.94 | 11.94 | 11.94 | 11.94 | 11.94 | 11.94 | 11.94 | 11.94 |
| | Total amount | | 100.00 | 100.00 | 100.00 | 100.00 | 100.00 | 100.00 | 100.00 | 100.00 | 100.00 | 100.00 |
| | Content of comb-shaped polymer or PMA (mass %) (*) | | 1.10 | 0.82 | 1.25 | 1.15 | 1.20 | 1.29 | 1.24 | 1.27 | 1.03 | 1.27 |
| Properties | Kinematic viscosity at 40° C. ($V_{40}$) | $mm^2/s$ | 27.6 | 27.7 | 26.8 | 26.6 | 26.6 | 26.3 | 26.2 | 26.2 | 30.0 | 29.4 |
| | Kinematic viscosity at 100° C. ($V_{100}$) | $mm^2/s$ | 6.08 | 6.52 | 6.43 | 6.56 | 6.62 | 6.33 | 6.33 | 6.43 | 6.92 | 6.68 |
| | Viscosity index | — | 178 | 203 | 206 | 216 | 211 | 206 | 206 | 211 | 203 | 195 |
| | HTHS viscosity at 100° C. ($T_{100}$) | mPa · s | 4.65 | 4.59 | 4.57 | 4.51 | 4.47 | 4.43 | 4.42 | 4.43 | 4.53 | 4.49 |
| | HTHS viscosity at 150° C. ($T_{150}$) | mPa · s | 2.31 | 2.30 | 2.30 | 2.30 | 2.30 | 2.30 | 2.30 | 2.30 | 2.30 | 2.30 |
| | $V_{40}/T_{150}$ | — | 11.9 | 12.0 | 11.6 | 11.6 | 11.6 | 11.5 | 11.4 | 11.4 | 13.0 | 12.8 |
| | Torque reduction: 1.5 L Gasoline engine at 1,500 rpm and at oil temperature of 40° C. | % | 1.08 | 0.77 | 1.19 | 1.29 | 1.34 | 1.82 | 1.88 | 1.75 | 0.00 (Basis) | 0.51 |

(*): The content of the comb-shaped polymer or PMA relative to the total amount (100 mass %) of the prepared lubricating oil composition is expressed.

It is noted from Tables 1 and 2 that the lubrication oil compositions of Examples 1 to 16 according to the embodiment of the present invention are high in torque reduction and excellent in fuel consumption reducing properties in a low-temperature region assuming the time of starting an engine at an oil temperature of 40° C., as compared with the lubricating oil compositions of Comparative Examples 1 to 4.

The invention claimed is:

1. A lubricating oil composition, comprising:

a viscosity index improver; and a base oil;

wherein:

the viscosity index improver comprises a comb-shaped polymer;

the comb-shaped polymer has a molecular weight distribution Mw/Mn of 1.01 or greater and less than 2.00, where Mw represents a weight average molecular weight of the comb-shaped polymer, and Mn represents a number average molecular weight of the comb-shaped polymer;

the comb-shaped polymer has a weight average molecular weight of 330,000 to 600,000;

a content of the comb-shaped polymer in the viscosity index improver is 60 to 100 mass % based on a total amount of a solid component in the viscosity index improver;

the comb-shaped polymer is present in an amount of 0.90 to 4.00 mass % based on the total mass of the composition;

the viscosity index improver has a shear stability index of 30 or less;

the base oil comprises a Group 3 mineral oil;

the base oil has a kinematic viscosity at 100° C. in $mm^2/s$ of 2.0 to 7.0;

the base oil is present in an amount of 70 to 95 mass % based on the total mass of the composition;

the lubricating oil composition has a high temperature high shear viscosity at 150° C. of 1.6 to 2.9 mPa·s; and a ratio of a kinematic viscosity at 40° C. in $mm^2/s$ of the lubricating oil composition to the high temperature high sheer viscosity at 150° C. of the lubricating oil composition is 8.00 to 12.4.

2. The lubricating oil composition according to claim 1, wherein the comb-shaped polymer is a polymer comprising at least a constituent unit derived from a macromonomer.

3. The lubricating oil composition according to claim 1, further comprising at least one additive for lubricating oil selected from the group consisting of a metal-based detergent, a dispersant, an anti-wear agent, an extreme pressure agent, an antioxidant, a pour-point depressant, and an anti-foaming agent.

4. The lubricating oil composition according to claim 3, which comprises the metal-based detergent, which is an organic metal-based compound containing a metal atom selected from the group consisting of an alkali metal atom and an alkaline earth metal atom.

5. The lubricating oil composition according to claim 1, wherein a kinematic viscosity at 100° C. of the lubricating oil composition is 4.0 to 12.5 $mm^2/s$.

6. The lubricating oil composition according to claim 1, wherein a kinematic viscosity at 40° C. of the lubricating oil composition is 10.0 to 40.0 $mm^2/s$.

7. The lubricating oil composition according to claim 1, wherein a viscosity index of the lubricating oil composition is 140 or more.

8. The lubricating oil composition according to claim 1, wherein a content of a polymethacrylate-based compound which is not the comb-shaped polymer is 0 to 30 parts by mass based on 100 parts by mass of the comb-shaped polymer contained in the lubricating oil composition.

9. A method for improving fuel consumption reducing property, the method comprising adding the lubricating oil composition according to claim 1 to a fuel in a low-temperature region at 10 to 60° C.

10. A method for producing a lubricating oil composition, the method comprising:

blending a base oil with a viscosity index improver to obtain the lubricating oil composition;

wherein:

the viscosity index improver comprises a comb-shaped polymer;

the comb-shaped polymer has a molecular weight distribution Mw/Mn of 1.01 or greater and less than 2.00, where Mw represents a weight average molecular weight of the comb-shaped polymer, and Mn represents a number average molecular weight of the comb-shaped polymer;

the comb-shaped polymer has a weight average molecular weight of 330,000 to 600,000;

a content of the comb-shaped polymer in the viscosity index improver is 60 to 100 mass % based on a total amount of a solid component in the viscosity index improver;

the comb-shaped polymer is present in an amount of 0.90 to 4.00 mass % based on the total mass of the composition;

the viscosity index improver has a shear stability index of 30 or less;

the base oil comprises a Group 3 mineral oil;

the base oil has a kinematic viscosity at 100° C. in $mm^2/s$ of 2.0 to 7.0;

the base oil is present in an amount of 70 to 95 mass % based on the total mass of the composition;

the lubricating oil composition has a high temperature high shear viscosity at 150° C. of 1.6 to 2.9 mPa·s; and a ratio of a kinematic viscosity of the lubricating oil composition at 40° C. $mm^2/s$ to the high temperature high sheer viscosity of the lubricating oil composition at 150° C. is 8.00 to 12.4.

11. The lubricating oil composition according to claim 1, wherein a ratio of a kinematic viscosity of the lubricating oil composition at 40° C. $mm^2/s$ to the high temperature high sheer viscosity of the lubricating oil composition at 150° C. is 8.00 to 11.2.

12. The lubricating oil composition according to claim 1, wherein the comb-shaped polymer has a weight average molecular weight of 360,000 to 600,000.

13. The lubricating oil composition according to claim 1, further comprising:

a dispersant;

an anti-wear agent;

an anti-foaming agent;

a metal-based detergent; and an antioxidant.

14. The lubricating oil composition according to claim 13, wherein:

the dispersant comprises at least one of a high-molecular weight bisimide and a boron-modified monoimide;

the anti-wear agent comprises at least one of a primary zinc dialkyldithiophosphate and a secondary zinc dialkyldithiophosphate; and the anti-foaming agent comprises a silicone-based anti-foaming agent.

15. The method according to claim 10, wherein the comb-shaped polymer has a weight average molecular weight of 360,000 to 600,000.

16. The method according to claim 10, wherein:

blending comprises blending a dispersant, an anti-wear agent, an anti-foaming agent, and a metal-based detergent together with the base oil and the viscosity index improver to obtain the lubricating oil composition.

17. The method according to claim 16, wherein:

the dispersant comprises at least one of a high-molecular weight bisimide and a boron-modified monoimide;

the anti-wear agent comprises at least one of a primary zinc dialkyldithiophosphate and a secondary zinc dialkyldithiophosphate; and the anti-foaming agent comprises a silicone-based anti-foaming agent.

* * * * *